US007281672B2

(12) United States Patent
Karalis et al.

(10) Patent No.: US 7,281,672 B2
(45) Date of Patent: Oct. 16, 2007

(54) DUAL BURST DISK

(75) Inventors: Peter Karalis, Watertown, MA (US); Raymond A. Stacy, Framingham, MA (US); Richard Zaven Karadizian, Westford, MA (US); James E. Marquedant, Mendon, MA (US); Neil O Brillhart, Whitinsville, MA (US); William Mahoney, Sudbury, MA (US)

(73) Assignee: Kidde-Fenwal, Inc., Ashland, MA (US)

( * ) Notice: Subject to any disclaimer, the term of this patent is extended or adjusted under 35 U.S.C. 154(b) by 397 days.

(21) Appl. No.: 11/077,197

(22) Filed: Mar. 10, 2005

(65) Prior Publication Data

US 2005/0205613 A1 Sep. 22, 2005

Related U.S. Application Data

(60) Provisional application No. 60/552,804, filed on Mar. 11, 2004.

(51) Int. Cl.

| | |
|---|---|
| ***A62C 13/62*** | (2006.01) |
| ***A62C 13/66*** | (2006.01) |
| ***A62C 5/02*** | (2006.01) |
| ***B05B 11/02*** | (2006.01) |

(52) U.S. Cl. ..... 239/302; 239/303; 239/309; 239/271; 239/272; 239/321; 239/322; 239/337; 239/8; 239/10

(58) Field of Classification Search ..... 239/302, 239/303, 309, 271, 272, 321, 322, 337, 8, 239/10

See application file for complete search history.

(56) References Cited

U.S. PATENT DOCUMENTS

| | | | | |
|---|---|---|---|---|
| 3,647,109 | A | 3/1972 | Hebblethwaite | |
| 5,232,053 | A | 8/1993 | Gillis et al. | |
| 5,449,041 | A | 9/1995 | Galbraith | |
| 6,390,292 | B2 * | 5/2002 | Hawthorne | 206/219 |
| 6,732,809 | B2 * | 5/2004 | Karadizian et al. | 169/28 |
| 2003/0205390 | A1 | 11/2003 | Karadizian et al. | |

FOREIGN PATENT DOCUMENTS

| | | |
|---|---|---|
| EP | 0 288 164 A2 | 10/1988 |
| GB | 985651 | 3/1965 |

* cited by examiner

*Primary Examiner*—Davis D. Hwu
(74) *Attorney, Agent, or Firm*—Merchant & Gould, P.C.

(57) ABSTRACT

An apparatus and method for dispensing fluid including a pressure vessel at a first pressure and a reservoir at a second pressure. The reservoir communicates with the pressure vessel via a first aperture and with an environment at a third pressure via a second aperture. A reservoir vent having open and closed positions, that when opened the reservoir vents to a fourth pressure, and when closed the reservoir does not vent. A piston moveably disposed within the reservoir, and defines an aperture therethrough. A first burst seal disposed in the first aperture seals the pressure vessel from the reservoir, and engaged with the piston to be moveable therewith. A second burst seal disposed in the second aperture seals the reservoir from the environment. When the reservoir vents to the fourth pressure, the piston ruptures the second seal, and a first and third pressure difference ruptures the first seal.

20 Claims, 8 Drawing Sheets

DUAL BURST DISK

The present application draws priority from U.S. Provisional Patent Application Ser. No. 60/552,804, filed Mar. 11, 2004, and entitled "Method and Apparatus for Dispensing Fluid Utilizing Dual Burst Seals", which is in its entirety incorporated herewith by reference.

FIELD OF THE INVENTION

The invention relates to an apparatus and method for dispensing fluid. More particularly, the invention relates to an apparatus and method for rapidly dispensing a fire extinguishing agent into an environment to extinguish or prevent a fire or explosion, without the use of explosives to dispense the agent.

BACKGROUND OF INVENTION

Agent for extinguishing and suppressing fires and explosions are in wide use. Since under some circumstances both fires and explosions can cause damage and/or injury very rapidly, often it is desirable to be able to dispense an extinguishing agent rapidly, as soon as possible after a fire or explosion is detected (or in same cases, anticipated).

However, conventional agents typically are stored at very high pressures, on the order of several hundred pounds per square inch or more. In addition, depending upon the size of the volume that is to be protected, a large amount of suppressant may be required. Thus, for at least some systems it may be desirable to combine high pressure delivery, high volume delivery, and rapid response time.

One approach that can provide these features is the use of a burst seal, also sometimes referred to as a burst disk. Typically, a pressure vessel containing suppressant will remain closed off with a burst seal during standby. When suppressant is to be dispensed, the burst seal is ruptured, allowing the suppressant to exit the pressure vessel.

Conventionally, burst seals may be ruptured using explosives. For example, a small explosive charge might be placed near the seal, so that when it is detonated the seal ruptures.

The use of explosives to rupture burst seals can result in a rapid discharge of fluid. However, the use of explosives is problematic. Explosive devices are regulated by the Department of Transportation (DOT), and thus special shipping or handling procedures may be necessary in moving them from place to place. Explosive devices are dangerous and can cause personal injury.

In addition, certain devices and/or locales may be governed by similar regulations which require special procedures, protective equipment, etc. Thus, the presence of explosives within a conventional apparatus may itself result in increased complexity, both in terms of design and maintenance and in terms of regulatory approval.

It may be known to rupture burst seals based on relative pressure differences. For example, a pressure vessel at a high pressure may have a reservoir attached thereto at a lower pressure, which in turn is disposed within an ambient pressure environment. Burst seals may be placed between the pressure vessel and the reservoir, and between the reservoir and the environment. If both of the seals have burst strengths less than the difference in pressure between the pressure vessel and the environment, the inner seal will burst, then the outer.

However, with such an arrangement the burst strength of both seals cannot be greater than what can be readily ruptured by the pressure difference between the pressure vessel and the environment. This may be of concern, especially with regard to the outer burst disk. Environments to which fluids, particularly fire suppressants, are to be delivered may include a variety of hazards that pose a risk of puncturing the outer seal. Typically, this vents the reservoir, and causes the fluid to be dispensed, possibly at an undesirable time.

In addition, the inner seal must have a minimum burst strength such that the pressure difference between the pressure vessel and the reservoir does not rupture it. Also, the outer seal must have minimum burst strength such that the pressure difference between the reservoir and the environment does not rupture it. Thus, both the seals themselves and their means of attachment may be closely constrained in terms of their required burst strength.

Moreover, systems such as that described may suffer from slow response time. In addition to any time required to vent the reservoir, the time to build up a sufficient pressure differential to rupture each of the two relatively strong seals may be greater than could be desired.

There is need for a method and apparatus for dispensing fluid that enables simplicity of construction, transportation, and use while providing rapid response time.

SUMMARY OF THE INVENTION

It is the purpose of the claimed invention to overcome these difficulties, thereby providing an improved apparatus and method for dispensing fluids, in particular but not limited to fire suppressants. More particularly, it is the purpose of the present invention to overcome these difficulties by providing an improved apparatus and method for dispensing fluids that holds a fluid static at an operating pressure until needed, and enables high-speed agent discharge and reliable actuation.

An exemplary apparatus for dispensing fluid in accordance with the principles of the present invention includes a pressure vessel adapted to contain fluid at a first pressure $P_1$, and a reservoir adapted to contain fluid at a second pressure $P_2$. The reservoir is in communication with the pressure vessel via a first aperture, and with an environment at a third pressure $P_3$ via a second aperture.

The apparatus includes a reservoir vent having open and closed positions, such that in the open position the reservoir vents therethrough to a fourth pressure $P_4$, and in the closed position the reservoir does not vent therethrough.

A piston is moveably disposed within the reservoir near the first aperture. The piston defines at least one piston aperture therethrough. A first burst seal is disposed in the first aperture so as to seal the pressure vessel from said reservoir. The first burst seal is engaged with the piston so as to be moveable therewith. A second burst seal is disposed in the second aperture so as to seal the reservoir from said environment.

A piston stop is arranged so as to stop the piston from exiting the second aperture.

The pressures are such that $P_1>P_3$, and $P_1>P_4$; that is, the first pressure is greater than both the third and the fourth pressures. Also, $P_2>P_3$, and $P_2>P_4$; that is, the second pressure also is greater than both the third and the fourth pressures. The second burst seal has a rupture strength $S_2$, such that $S_2 \geqq |P_2-P_3|$. In other words, the burst strength of the second seal is greater than or equal to the difference between the second and third pressures.

When the reservoir vents to the fourth pressure $P_4$, the first burst seal and the piston move toward the second aperture under a pressure difference $|P_1-P_4|$ such that the piston ruptures the second burst seal. The first burst seal has a rupture strength $S_1$, such that $S_1>|P_1-P_2|$ and $S_1\leqq|P_1-P_3|$, that is, the burst strength of the first seal is greater than the difference between the first and second pressures, but less than or equal to the difference between the first and third pressures. Therefore, when the piston stop stops the piston, the pressure difference $|P_1-P_4|$ ruptures the first burst seal. Fluid then may pass through the piston apertures.

The piston may have a punch thereon.

The first and second pressures may be such that prior to venting the reservoir $P_1=P_2$. The apparatus may include a pressure equalization port in communication with the pressure vessel and the reservoir, so as to maintain $P_1=P_2$ prior to venting the reservoir.

However, the first and second pressures may be such that prior to venting the reservoir $P_1>P_2$, or $P_2>P_1$.

Either or both of the pressure vessel and the reservoir may have an incompressible fluid disposed therein.

The third and fourth pressures may be such that $P_3=P_4$.

The reservoir vent may be such that it does not include any DOT-rated explosives. Moreover, the entire apparatus may be such that it does not include any DOT-rated explosives.

An exemplary embodiment of a method for dispensing a fluid in accordance with the principles of the present invention includes disposing the fluid in a pressure vessel at a first pressure $P_1$, disposing a reservoir at a second pressure $P_2$, and disposing the reservoir in communication with the pressure vessel via a first aperture and with an environment at a third pressure $P_3$ via a second aperture.

The method includes movably disposing a piston within the reservoir, and disposing a first burst seal in the first aperture so as to seal the pressure vessel from the reservoir, the first burst seal being engaged with the piston so as to be movable therewith. A second burst seal is disposed in the second aperture so as to seal the reservoir from the environment.

The reservoir is vented o a fourth pressure $P_4$.

The pressures are such that $P_1>P_3$, and $P_1>P_4$, and that $P_2>P_3$, and $P_2>P_4$. The second burst seal has a rupture strength $S_2$, such that $S_2\geqq|P_2-P_3|$.

Thus, when the reservoir vents to the fourth pressure $P_4$, the first burst seal and the piston move toward the second aperture under a pressure difference $|P_1-P_3|$ such that the piston ruptures the second burst seal. The first burst seal has a rupture strength $S_1$, such that $S_1>|P_1-P_2|$ and $S_1>|P_1-P_3|$, whereby when the piston stop stops the piston, the pressure difference $|P_1-P_4|$ ruptures the first burst seal, such that fluid passes through the piston apertures.

The method may include disposing a punch on the piston such that the punch ruptures the second burst seal.

The method may include maintaining $P_1=P_2$ prior to venting the reservoir. A pressure equalization port may be defined in communication with the pressure vessel and the reservoir, so as to maintain $P_1=P_2$ prior to venting the reservoir.

However, the first and second pressures may be such that $P_1>P_2$ prior to venting said reservoir, or $P_2>P_1$ prior to venting said reservoir.

The method may include disposing an incompressible fluid within either or both the pressure vessel and the reservoir.

The third and fourth pressures may be such that $P_3=P_4$.

The method may include venting the reservoir without using DOT-rated explosives. Moreover, the method may include dispensing the fluid without using DOT-rated explosives.

These and other various advantages and features of novelty, which characterize the invention, are pointed out in the following detailed description. For better understanding of the invention, its advantages, and the objects obtained by its use, reference should also be made to the drawings which form a further part hereof, and to accompanying descriptive matter, in which there are illustrated and described specific examples of an apparatus in accordance with the invention.

BRIEF DESCRIPTION OF THE DRAWINGS

Like reference numbers generally indicate corresponding elements in the figures.

DETAILED DESCRIPTION OF THE PREFERRED EMBODIMENT

Figure 1:
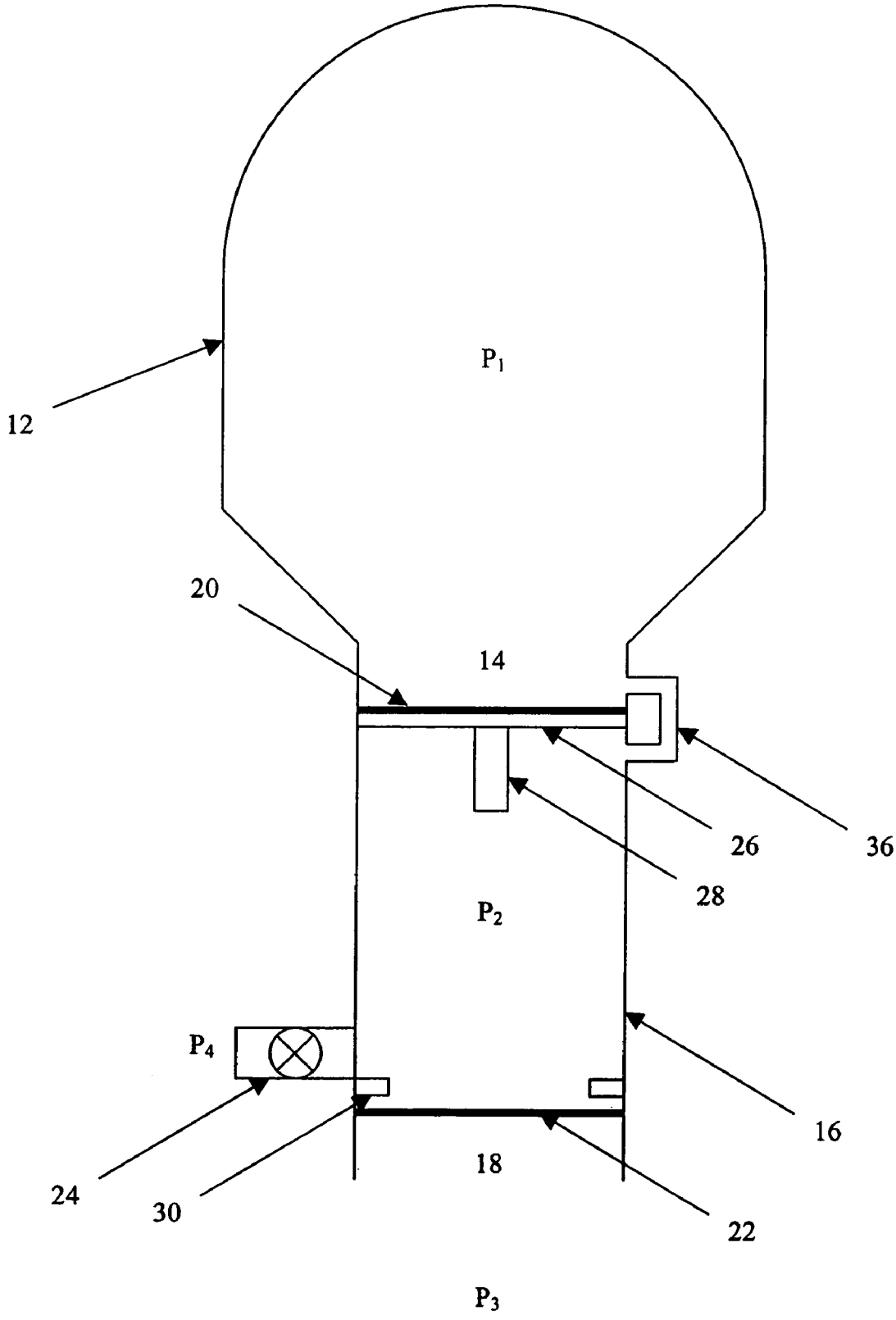
FIG. 1 illustrates in schematic form an exemplary embodiment of an apparatus for dispensing fluid in accordance with the principles of the present invention, in standby mode.

Referring to FIG. 1, an exemplary embodiment of an apparatus 10 for dispensing fluid in accordance with the principles of the present invention is shown. As illustrated, the apparatus 10 is in standby mode. That is, the apparatus 10 is not dispensing fluid, but it is ready to be activated so as to dispense fluid.

For certain embodiments, the apparatus 10 will remain in standby modes for long periods of time. For example, certain embodiments may be suitable for dispensing a fire extinguishing agent. Because fires generally are rare, the apparatus 10 may spend the great majority of its time in standby mode, without actually operating so as to dispense fluid. Indeed, it may be that such an apparatus 10 is never activated to suppress a fire.

For purposes of description herein, the fluid dispensing apparatus 10 will be considered to be a fire suppression apparatus 10, for dispensing a fluid that inhibits, suppresses, or extinguishes flames and/or explosions. However, such an arrangement is exemplary only. Other embodiments of the fluid dispensing apparatus 10 for dispensing other fluids and/or other purposes may be equally suitable.

As shown in FIG. 1, the apparatus 10 includes a pressure vessel 12. The pressure vessel 12 serves to contain fluid while the apparatus 10 is in standby mode. The fluid in the pressure vessel 12 is at a first pressure $P_1$ while the apparatus 10 is in standby mode.

The type of fluid in the pressure vessel 12 (and which is to be dispensed) is not particularly limited. For example, for fire suppression suitable fluids include but are not limited to HFC-227ea (1,1,1,2,3,3,3-Heptaflurorpropane $CF_3CHFCF_3$) and other hydrofluorocarbons, HALON® 1301 (bromotrifluoromethane $CBrF_3$), carbon dioxide ($CO_2$) in liquid or gaseous form, and sodium bicarbonate ($NaHCO_3$). It will be appreciated that these are only exemplary type of fluids that may be used and that other fluids with similar suppression properties may equally be desirable, including but not limited to other liquefied compressed gases, inert gases, water and dry chemical extinguishing agents. Likewise, other fluids may be employed that may or may not be designed for fire suppression applications and may be employed for other dispensing purposes.

It is noted that the term "fluid" sometimes is used to denote only a liquid or a gas. This is not the case herein. With regard to both the exemplary embodiment of the apparatus 10 for suppressing fires specifically described herein and the fluid dispensing apparatus in general, the term "fluid" is used herein in a broad sense, and should be considered to include any substance that may be made to flow. This includes, but is not limited to, liquids, gases, granular or powdered solids, foams, mixtures or emulsions of two or more fluids, suspensions of solids within liquids or gases, etc. Thus, although liquids and gases are by no means excluded from use with a fluid dispensing apparatus in accordance with the principles of the present invention, a fluid dispensing apparatus 10 adapted for extinguishing fires may for example dispense a dry chemical, such as sodium bicarbonate, without necessarily dispensing either liquids or gases.

In addition, although for simplicity the fluid dispensing apparatus 10 is described herein as dispensing a single fluid, this is not necessarily the case. Two or more fluids may be dispensed, simultaneously or in sequence. Furthermore, fluids or other than those to be dispensed may be utilized within the apparatus 10.

For example, for certain embodiments the apparatus 10 may hold a fire suppression fluid for suppressing a fire, and a propellant fluid. This might be arranged, for example, by disposing a liquid fire suppressant in the bottom portion of the pressure vessel 12 and a non-combustible propellant gas in the top portion. Such an arrangement is exemplary only however, and other arrangements may be equally suitable.

Fluids in the apparatus 10 may be compressible, incompressible or a mixture of both.

The relationship of $P_1$ to other pressures relevant to the operation of the apparatus 10 described is described in further detail below. However, the actual value of $P_1$ is not particularly limited, and may vary considerably depending on the mechanical particulars of the specific apparatus 10, the fluid or fluids to be dispensed, etc. For example, for fire suppressants the pressure typically may range up to several hundred pounds per square inch (psi).

Suitable fluids and pressure vessels 12 are known per se, and are not described in further detail herein.

The apparatus 10 is provided with a fluid release mechanism. The fluid release mechanism includes a reservoir 16. The reservoir 16 also contains fluid, which is at a second pressure $P_2$ while the apparatus 10 is in standby mode. The fluid in the reservoir 16 may have the same composition as the fluid in the pressure vessel 12, or the fluids may be different.

The reservoir 16 is in communication with the pressure vessel 12 via a first aperture 14. The reservoir 16 also is in communication with an environment outside of the apparatus 10 via a second aperture 18. The environment is at a third pressure $P_3$.

In addition, the apparatus 10 includes a reservoir vent 24. The reservoir vent 24 has open and closed positions. Preferably the reservoir vent 24 provides a non-explosive means for actuating the apparatus 10 to dispense fluid, whereby the reservoir vent 24 vents pressure from the reservoir 16. The reservoir vent 24 may be opened/closed in any number of ways including manual operation or by employing any operation means so as to remotely open and close it. In the open position, the reservoir vent 24 puts the reservoir 16 in communication with a volume at a fourth pressure $P_4$. Thus, with the reservoir vent 24 open the reservoir 16 vents so that the pressure in the reservoir 16 also approaches $P_4$.

A piston 26 is movably displaced within the reservoir 16. A first burst seal 20 is disposed in the first aperture 14 so as to seal the pressure vessel 12 from the reservoir 16. The first burst seal 20 is engaged with the piston 26, so as to be movable therewith.

Thus, the combination of piston 26 and first burst seal 20 are movable together within the reservoir 16.

Figure 7:
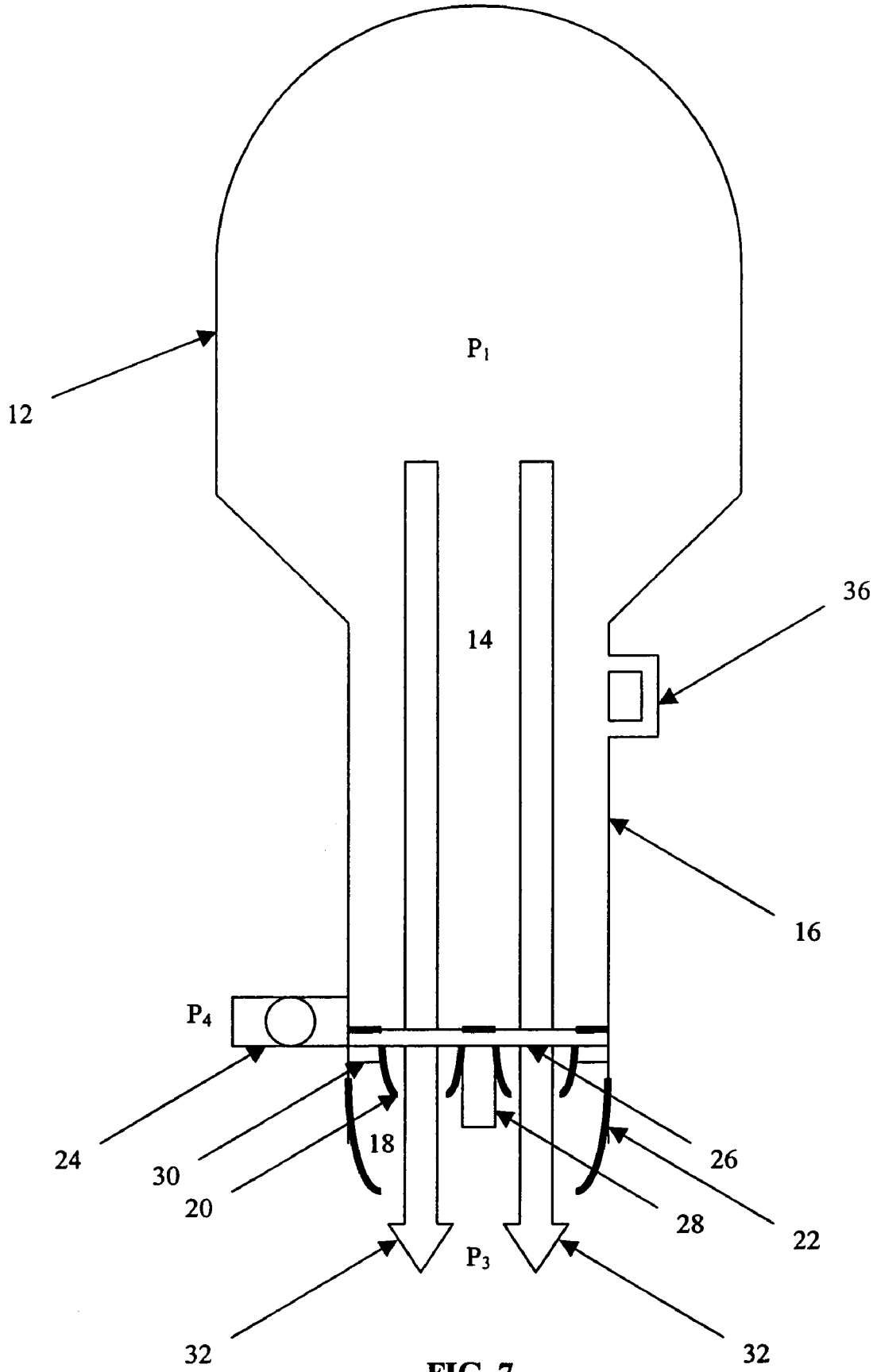
FIG. 7 illustrates in schematic form the apparatus of FIG. 1, with fluid being dispensed.
Figure 8B:
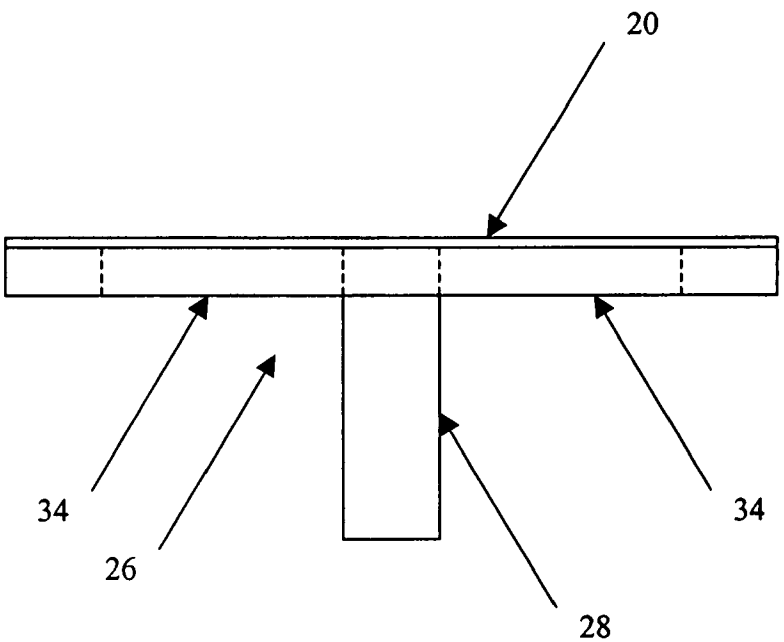
FIG. 8B shows a bottom view of another exemplary embodiment of a piston in accordance with the principles of the present invention.
Figure 8A:
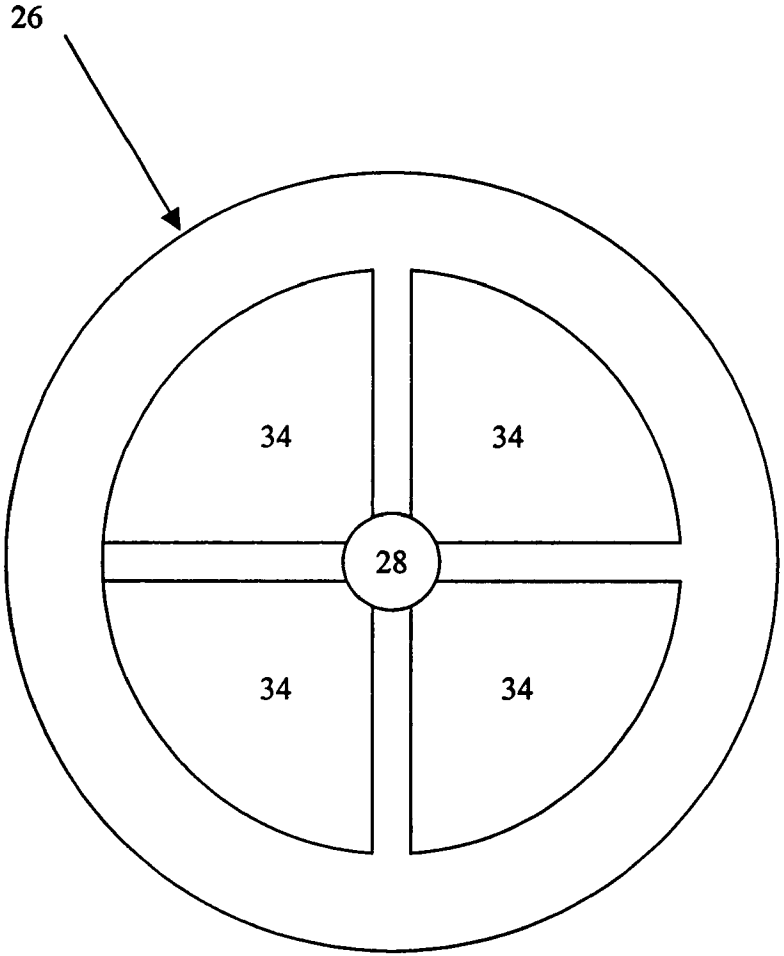
FIG. 8A shows a bottom view of an exemplary embodiment of a piston in accordance with the principles of the present invention.

Referring to FIG. 8A, the piston 26 defines at least one piston aperture 34 therethrough. (For simplicity, the piston apertures are not shown in FIGS. 1-7.) As shown in FIG. 8B, the first burst seal 20 obstructs the piston apertures 34 during standby mode.

The arrangement of the piston 26 and the first burst seal 20, as shown in FIG. 8B, may be considered in some sense analogous to that of a sailing ship and its sail. A pressure differential applied to the first burst seal 20 will cause both the piston 26 and the first burst seal 20 to move together as a unit within the reservoir 16. This arrangement is further described below.

As illustrated in FIG. 8B, the piston 26, is formed as a cross shape with a surrounding ring, and so defines the piston apertures 34 in quadrants thereof. However, this is exemplary only. Other arrangements that can provide a suitable aperture structure, including but not limited to a cross shape alone and a ring shape alone may be equally suitable.

The apparatus 10 includes a piston stop 30 arranged so as to prevent the piston 26 from moving beyond the second aperture 18. As shown in FIG. 1, the piston stop 30 is a pair of projecting ridges arranged on the inside of the reservoir 16 near the second aperture 18, that mechanically obstruct the piston 26 and prevent it from exiting the second aperture 18. However, this arrangement is exemplary only. Other arrangements for a stop structure may be employed, such as including but not limited to a tension line limiting the movement of the piston 26, may be equally suitable for stopping the piston 26, and thus for use as the piston stop 30.

The apparatus 10 also includes a second burst seal 22 disposed in the second aperture 18, so as to seal the reservoir 16 from the environment.

It should be noted that for some embodiments, the precise positions the first and second apertures 14 and 18 might be considered to be at least somewhat variable. For example, for the embodiment shown in FIG. 1 the reservoir 16 is shown essentially as a straight-sided tube, so that the positions of the first and second apertures 14 and 18 are not sharply defined by rigid "landmarks." Thus, the first and second burst seals 20 and 22 need not be positioned exactly as illustrated; their positions may vary, so long as the apparatus 10 functions as described herein. The first and second burst seals 20, 22 may be metallic burst disks, such as but not limited to copper, and are mechanically attached within the respective first and second apertures 14, 18. It will be appreciated, however, that the first and second burst seals 20, 22 may be made of other materials having physical properties satisfactory for operation of the apparatus 10 and which may be equally suitable. In addition, the first burst seal 20 may be made as an integral part of the piston 26.

The first, second, third, and fourth pressures $P_1$, $P_2$, $P_3$, and $P_4$ are related as follows. The first pressure $P_1$, the pressure inside the pressure vessel 12, is greater than the third pressure $P_3$, the environmental pressure. That is $P_1>P_3$.

The first pressure $P_1$ inside the pressure vessel 12 also is greater than the fourth pressure $P_4$, the venting pressure. That is, $P_1>P_4$.

However, the relationship between the first pressure $P_1$ and the second pressure $P_2$ is not particularly limited. Although for certain embodiments it may be convenient if $P_1=P_2$, this is exemplary only. The first pressure $P_1$ may be greater than, equal to, or less than the second pressure $P_2$.

The first burst seal 20 has a rupture strength $S_1$, wherein $S_1$ is greater than the difference between the first pressure $P_1$and the second pressure $P_2$. The rupture strength $S_1$ of the first burst seal 20 also is less than or equal to the difference between the first pressure $P_1$ and the third pressure $P_3$. That is, $S_1>|P_1-P_2|$, and $S_1\leqq|P_1-P_3|$.

The second burst seal 22 has a rupture strength of $S_2$, wherein $S_2$ is greater than the difference between the second pressure $P_2$ and the third pressure $P_3$. That is, $S_2>|P_2-P_3|$.

In addition, if necessary, for cases wherein $P_1$ and $P_2$ are not equal in standby, some provision may be made to hold the piston 26 and the first burst seal 20 in place against the pressure differential. Such arrangements may include, but are not limited to, frangible pins or adhesives that can withstand the pressure differential $|P_1-P_2|$ present in standby but not the pressure differential $|P_1-P_4|$ produced upon activation, and friction between the piston 26 and/or the first burst seal 20 and the inner wall of the reservoir 16. Suitable arrangements are known per se, and are not described further herein.

Thus, when the apparatus 10 is in standby mode, with pressures as shown in FIG. 1, the arrangement is stable. The piston 26 and first burst seal 20 either are held immovable against the pressure differential $|P_1-P_2|$ or, if $P_1$ and $P_2$ are equal, do not experience a pressure differential. Thus, the piston 26 and first burst seal 20 do not move. The first burst seal 20 has a burst strength $S_1$ greater than the pressure differential $|P_1-P_2|$ (if any), and so does not rupture. The second burst seal 22 has a burst strength $S_2$ greater than the pressure differential $|P_2-P_3|$, and so also does not rupture. This arrangement may be maintained indefinitely.

Figure 2:
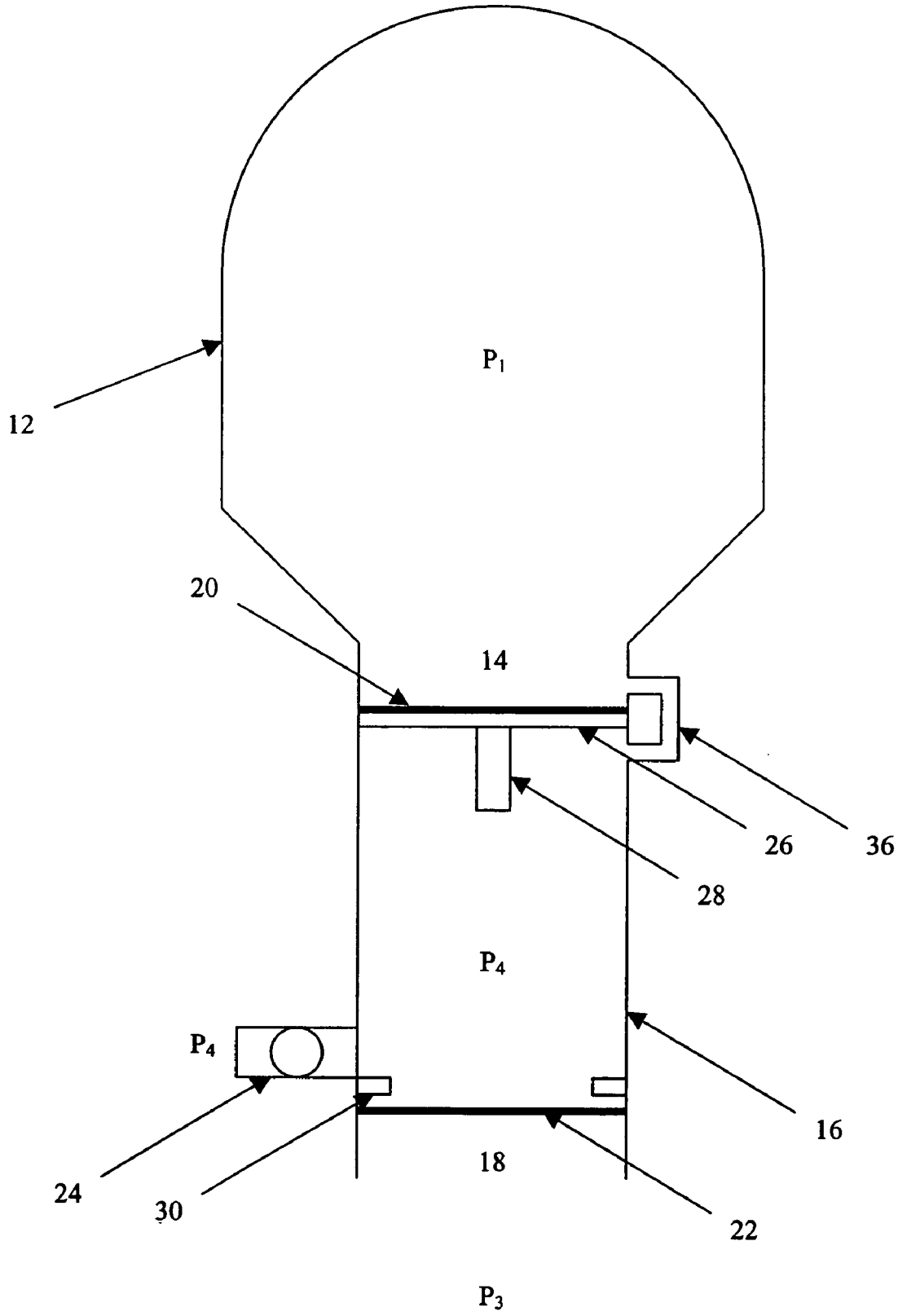
FIG. 2 illustrates in schematic form the apparatus of FIG. 1, with the reservoir vented.

When the apparatus 10 is to be activated so as to dispense the fluid, the reservoir vent 24 is opened, as shown in FIG. 2. The reservoir 16 vents through the reservoir vent 24, so that the pressure therein approaches the fourth pressure $P_4$.

For purposes of simplicity in describing the operation of the apparatus 10, this and other pressure changes are considered to be instantaneous. In practice, the change in pressure from $P_2$ to $P_4$ may not be and need not be either instantaneous. Nor must the change in pressure be total; that is, it may not be necessary, for example, for the pressure within the reservoir 16 to completely equalized and become stable at $P_4$ in order for the apparatus 10 to operate as described herein.

However, as the reservoir 16 vents to the fourth pressure $P_4$, the pressure differential acting on the combination of piston 26 and the first burst seal 20 increases towards $|P_1-P_4|$.

It is noted that, depending on the value of $P_4$ compared to $P_3$, the pressure differential $|P_1-P_4|$ might be considered sufficient to rupture the first burst seal 20. However, so long as the piston 26 and the first burst seal 20 are movable so as to relieve the pressure, the rupture of the first burst seal 20 may be avoided even if $|P_1-P_4|$ exceeds its nominal burst strength $S_1$.

Figure 3:
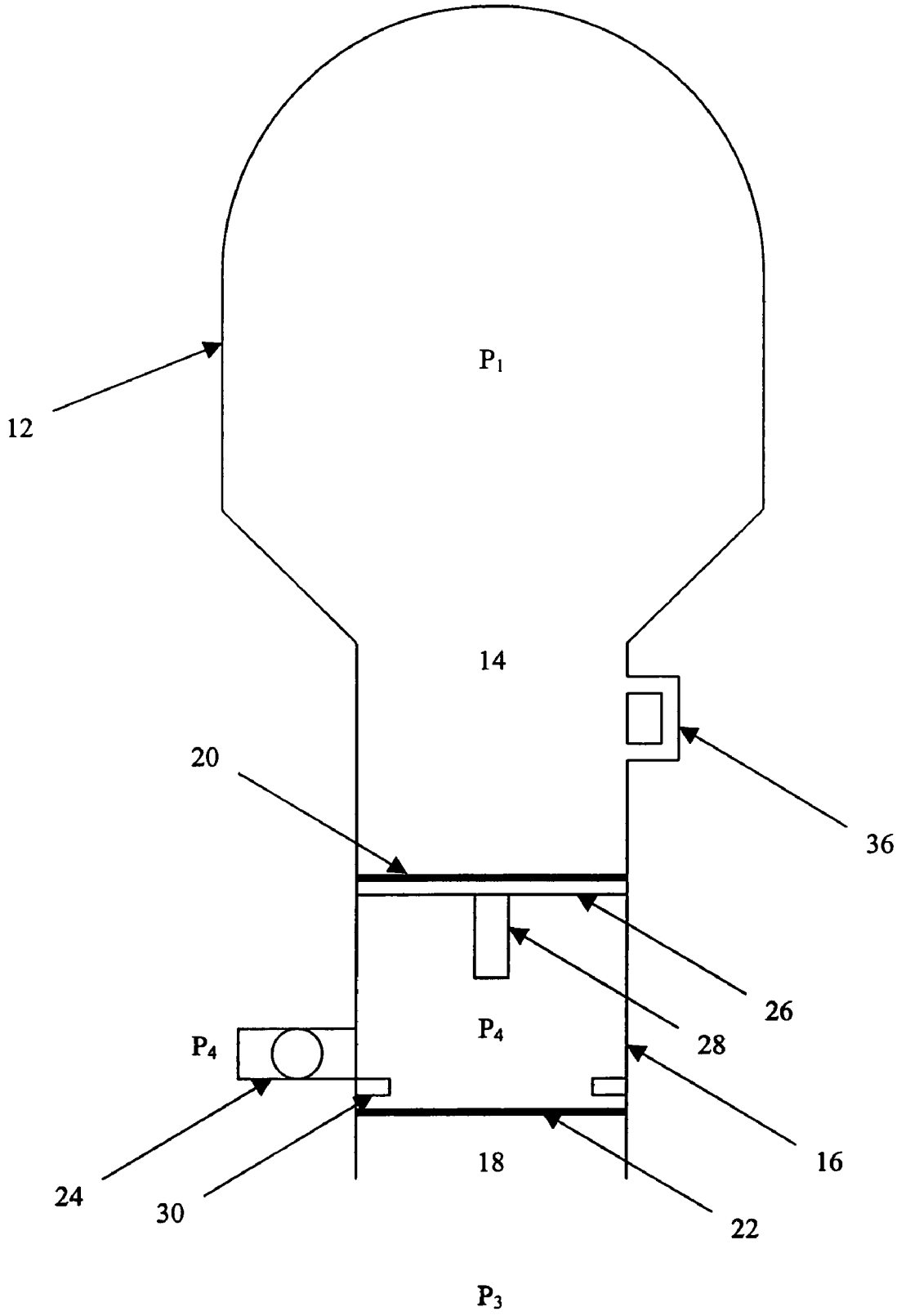
FIG. 3 illustrates in schematic form the apparatus of FIG. 1, with the piston moving.

Turning to FIG. 3, the piston 26 and the first burst seal 20 are shown to have begun moving towards the second burst seal 22. For purposes of clarity, the travel distance of the piston 26 within the reservoir 16 is greatly exaggerated as illustrated. The actual distance depends to at least some degree on the details of the particular embodiment, i.e. the first and fourth pressures $P_1$ and $P_4$, the anticipated burst strength $S_2$ of the second burst seal 22, and so forth. However, in practice the travel distance for the piston 26 may be relatively small for at least some embodiments. For example, for dispersing fire suppressant a travel distance on the order of half an inch has been found to be suitable for certain embodiments.

Figure 4:
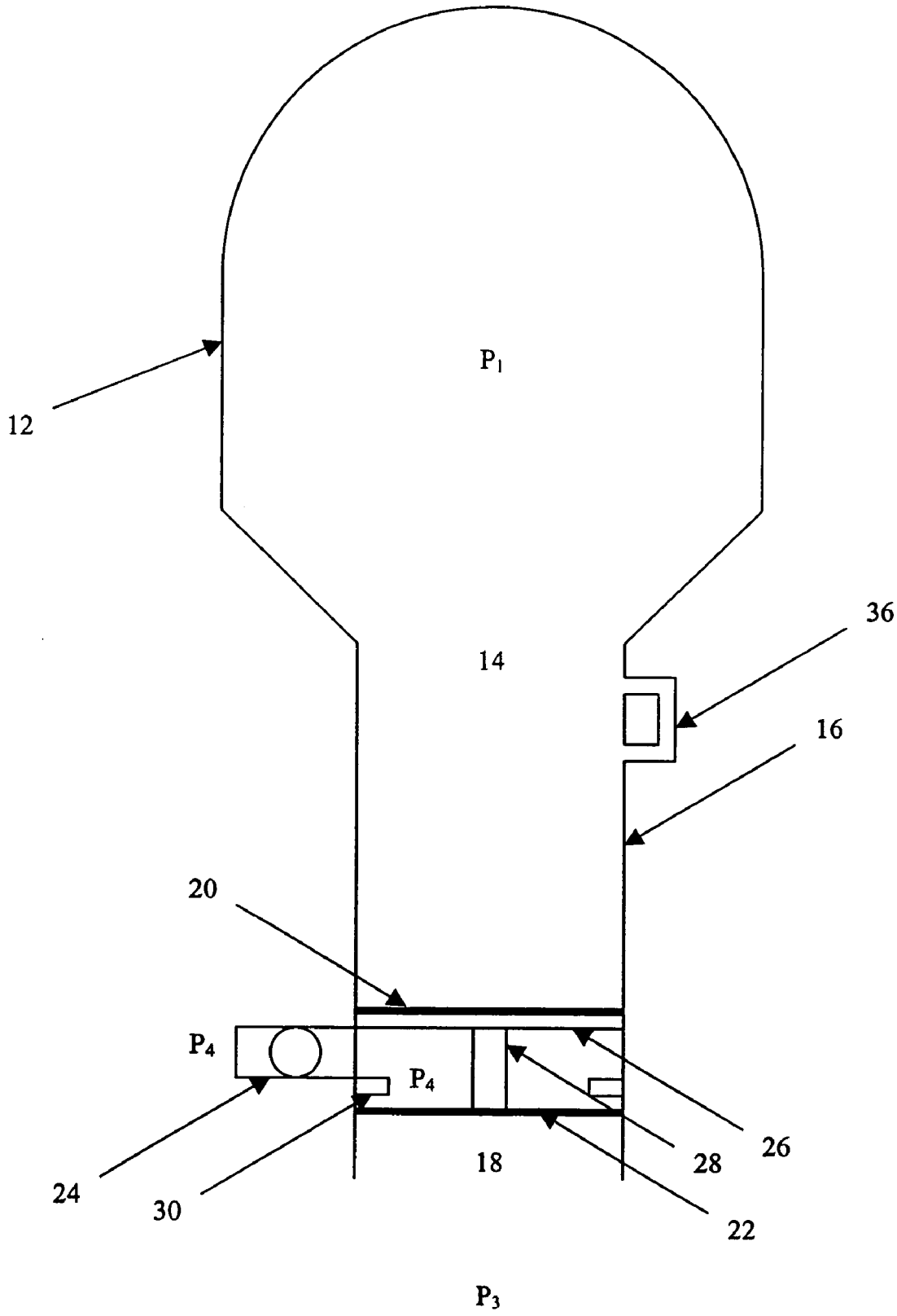
FIG. 4 illustrates in schematic form the apparatus of FIG. 1, with the piston approaching the second burst seal.

FIG. 4 shows the piston 26 and first burst seal 20 at a point further along in their motion, with the piston 26 approaching the second burst seal 22.

Figure 5:
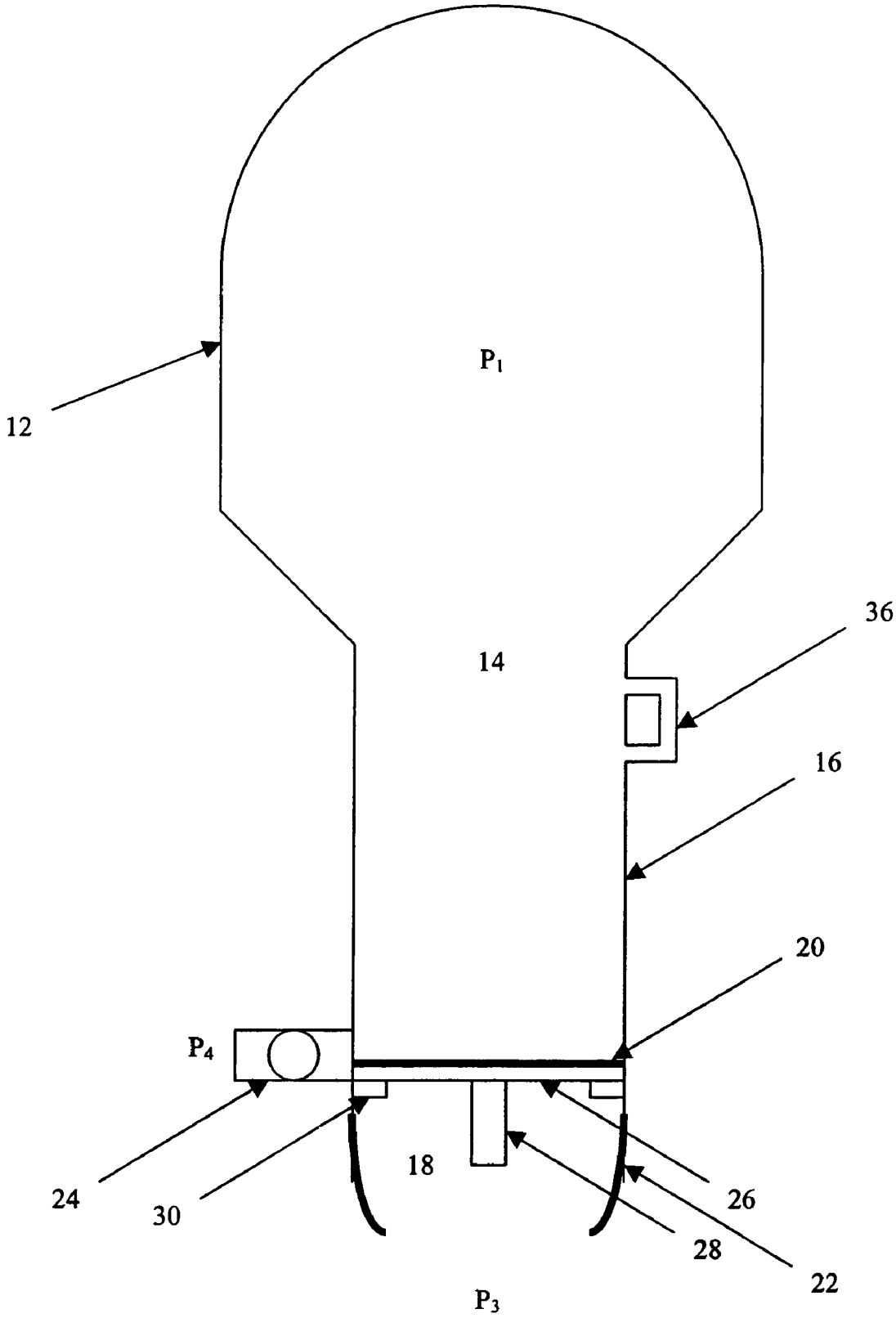
FIG. 5 illustrates in schematic form the apparatus of FIG. 1, with the second burst seal ruptured.

FIG. 5, in turn, shows the piston at its point of maximum travel, having been stopped by the piston stops 30. As may be seen from FIG. 5, the motion of the piston 26 ruptures the second burst seal 22.

Thus, although the piston 26 is impelled by the pressure differential $|P_1-P_4|$, the second burst seal 22 is not ruptured due to a pressure differential per se. Rather, the second burst seal 22 is ruptured mechanically, by the piston 26.

As illustrated, the piston 26 may include a punch 28 thereon to facilitate the rupture of the second burst seal 22. As shown, the punch 28 is blunt, however, this is exemplary only, and other arrangements, including but not limited to punches with sharp edges, points, "teeth", etc. may be equally suitable.

The use of a punch 28, in particular an arrangement as illustrated, concentrates the force of the piston 26 into a smaller area so as to more readily rupture the second burst seal 22. However, this is exemplary only, and other arrangements for the piston 26 may be equally suitable. As shown, the apparatus 10 is configured such that the punch 28 is disposed on a bottom of the piston 26 with the first burst seal 20 disposed on a top of the piston 26. Thus, from top to bottom the first burst seal 20 is disposed on top of the piston 26, in which the piston 26 is disposed on top of the punch 28. However, this arrangement is merely exemplary, as other arrangements may be equally suitable. As one example, the first burst seal 20 may be disposed between the piston 26 and the punch 28, such that the piston 26 is disposed on top of the first burst seal 20, and in which the first burst seal 20 is disposed on top of the punch 28.

Because the second burst seal 22 is not required to rupture at a specific pressure, but rather is ruptured mechanically, no well-defined upper limit for the rupture strength $S_2$ of the second burst seal 22 must be set. As a result, the second burst seal 22 may be made extremely strong. As one example only, the second burst seal 22 may be stronger than the first burst seal 20. For certain embodiments, it may be preferable for the rupture strength $S_2$ of the second burst seal 22 to be high enough that the second burst seal 22 is resistant to damage from some or all of the hazards that may be anticipated to be present in an environment into which fluid is to be dispensed.

Once the piston 26 has ruptured the second burst seal 22, any portion of the reservoir 16 accessible to the environment via the second aperture 18 vents to the pressure of the environment, the third pressure $P_3$. Thus, the pressure differential on the first burst seal 20 becomes $|P_1-P_3|$.

Figure 6:
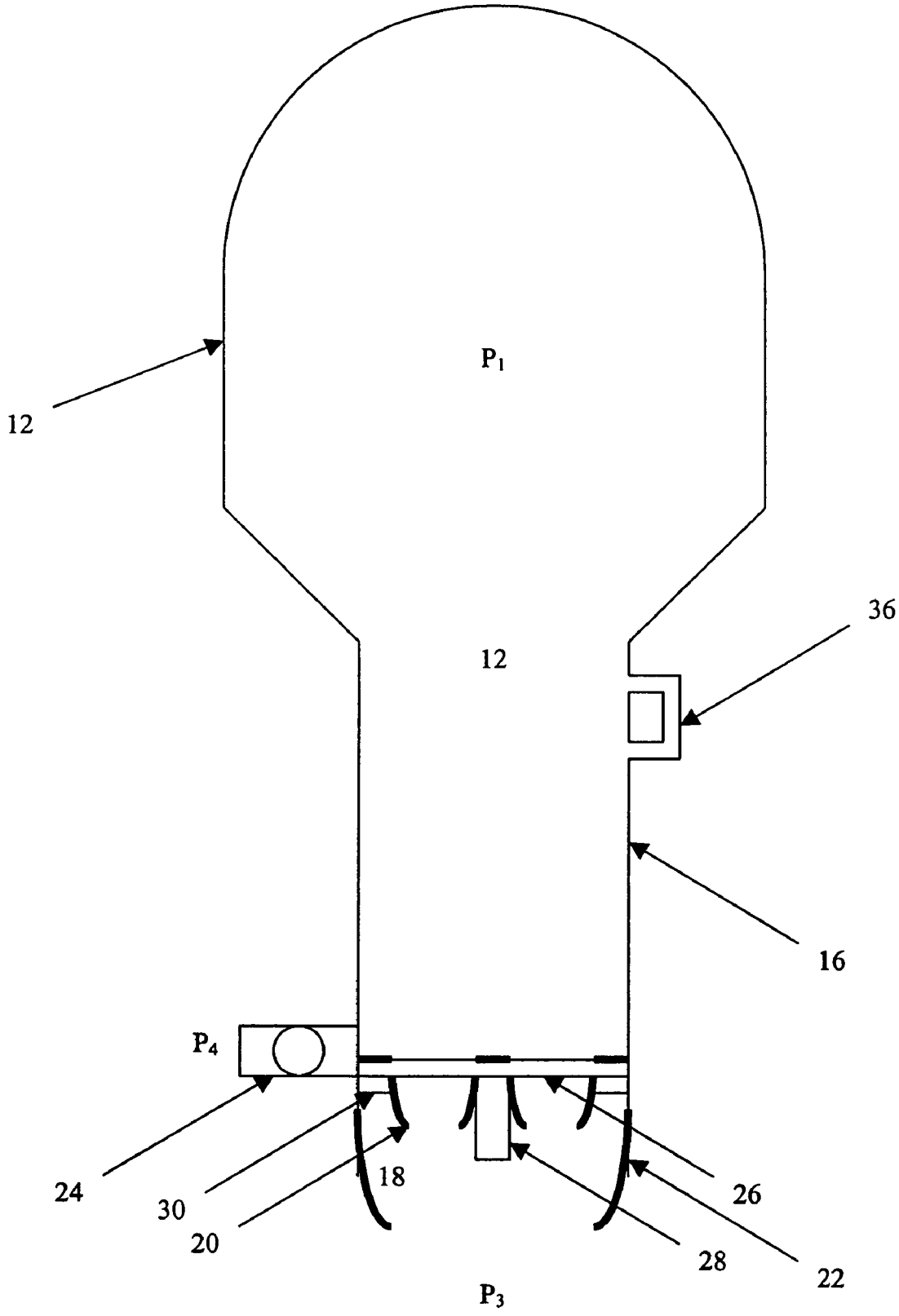
FIG. 6 illustrates in schematic form the apparatus of FIG. 1, with the first and second burst seal ruptured.

Turning to FIG. 6, once the piston 26 has been stopped by the piston stops 30, the pressure differential $|P_1-P_3|$ on the first burst seal 20 cannot be relieved by the motion of the piston 26 in the same manner as the pressure differential $|P_1-P_4|$ previously was, as described above. As previously noted, the rupture strength $S_1$ of the first burst seal 20 is less than or equal to $|P_1-P_3|$. Thus, the first burst seal 20 ruptures, as shown in FIG. 6.

With the rupture of both burst seals 20 and 22, a flow 32 of fluid from the pressure vessel 12 into the environment is enabled, as shown in FIG. 7. More particularly, fluid passes from the pressure vessel 12, through the first aperture 14, through the reservoir 16, through the piston apertures 34 in the piston 26, and through the second aperture 18 into the environment. Fluid thus is dispensed by the apparatus 10 into the environment.

As noted previously, the reservoir 16 is vented to a fourth pressure $P_4$, while the fluid is dispensed to a third pressure $P_3$. For certain embodiments, it may be preferable that $P_3=P_4$, that is, that the third and fourth pressures are equal. Moreover, for certain embodiments it may be advantageous for the reservoir 16 to be vented to the environment $P_3$. This would render $P_3=P_4$. However, the third and fourth pressures are not required to be equal, and other arrangements may be equally suitable.

Similarly, for certain embodiments it may be preferable that the first pressure $P_1$ in the pressure vessel 12 and the second pressure $P_2$ in the reservoir 16 are equal, that is, it may be that $P_1=P_2$. In particular, for certain embodiments it may be advantageous for the pressure vessel 12 and the reservoir 16 to be in communication so as that their pressure is maintained equal during standby mode.

One arrangement for maintaining $P_1=P_2$ in standby mode is for the apparatus 10 to include a pressure port 36 linking the pressure vessel 12 and the reservoir 16. The pressure port 36 may configured as any suitable leak path that links the pressure vessel 12 to the reservoir 16. Such an arrangement is shown in FIGS. 1-7.

If present, such a pressure port 36 could be configured so that the flow of fluid therethrough between the pressure vessel 12 and the reservoir 16 is slow compared to the flow of fluid associated with venting the reservoir 16. With the flow through the pressure port 36 kept small, the flow of fluid therethrough between the pressure vessel 12 and the reservoir 16 would not substantially affect the operation of the apparatus 10 when dispensing fluid.

For certain embodiments, it may be preferable for the reservoir vent 24 to begin venting very rapidly upon activation. Rapid initiation of venting may contribute to rapid dispensing of fluid from the apparatus 10. In particular, for some embodiments it may be preferable that the reservoir vent 24 begins venting within 25 milliseconds of activation. For other embodiments it may be preferable that the reservoir vent 24 begins venting within 10 milliseconds of activation. For still other embodiments it may be preferable that the reservoir vent 24 begins venting within 5 milliseconds of activation.

Also, for certain embodiments, it may be preferable for the reservoir vent 24 to vent the reservoir 16 very rapidly from the second pressure $P_2$ to the fourth pressure $P_4$ upon activation. Rapid venting also may contribute to rapid dispensing of fluid from the apparatus 10. In particular, for some embodiments it may be preferable that the reservoir vent 24 vents the reservoir 16 to the second pressure $P_2$ within 25 milliseconds of activation. For other embodiments it may be preferable that the reservoir vent 24 vents the reservoir 16 to the second pressure $P_2$ within 10 milliseconds of activation. For still other embodiments it may be preferable that the reservoir vent 24 vents the reservoir 16 to the second pressure $P_2$ within 5 milliseconds of activation.

Further, for certain embodiments, it may be preferable for the apparatus 10 to begin dispensing fluid very rapidly upon activation. In particular, for some embodiments it may be preferable that the apparatus 10 begins dispensing fluid to the environment within 25 milliseconds of activation. For other embodiments it may be preferable that the apparatus 10 begins dispensing fluid to the environment within 10 milliseconds of activation. For still other embodiments it may be preferable that the apparatus 10 begins dispensing fluid to the environment within 5 milliseconds of activation.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. An apparatus for dispensing fluid, comprising:

a pressure vessel adapted to contain fluid at a first pressure $P_1$;

a reservoir adapted to contain fluid at a second pressure $P_2$, said reservoir being in communication with said pressure vessel via a first aperture and with an environment at a third pressure $P_3$ via a second aperture;

a reservoir vent having open and closed positions, such that in said open position said reservoir vents therethrough to a fourth pressure $P_4$, and in said closed position said reservoir does not vent therethrough;

a piston moveably disposed within said reservoir proximate said first aperture, said piston defining at least one piston aperture therethrough;

a first burst seal disposed in said first aperture so as to seal said pressure vessel from said reservoir, said first burst seal being engaged with said piston so as to be moveable therewith;

a second burst seal disposed in said second aperture so as to seal said reservoir from said environment;

a piston stop arranged so as to stop said piston from exiting said second aperture;

wherein $P_1>P_3$, and $P_1>P_4$;

$P_2>P_3$, and $P_2>P_4$;

said second burst seal has a rupture strength $S_2$, such that $S_2 \geqq |P_2-P_3|$;

when said reservoir vents to said fourth pressure $P_4$, said first burst seal and said piston move toward said second aperture under a pressure difference $|P_1-P_4|$ such that said piston ruptures said second burst seal; and said first burst seal has a rupture strength $S_1$, such that $S_1>|P_1-P_2|$ and $S_1 \leqq |P_1-P_3|$, whereby when said piston stop stops said piston, said pressure difference $|P_1-P_3|$ ruptures said first burst seal, such that fluid passes through said piston apertures.

2. The apparatus according to claim 1, wherein:

said piston comprises a punch thereon.

3. The apparatus according to claim 1, wherein:
$P_1=P_2$ prior to venting said reservoir.
4. The apparatus according to claim 3, wherein:
a pressure equalization port in communication with said pressure vessel and said reservoir, so as to maintain $P_1=P_2$ prior to venting said reservoir.
5. The apparatus according to claim 1, wherein:
$P_1>P_2$ prior to venting said reservoir.
6. The apparatus according to claim 1, wherein:
$P_2>P_1$ prior to venting said reservoir.
7. The apparatus according to claim 1, wherein:
at least one of said pressure vessel and said reservoir has an incompressible fluid disposed therein.
8. The apparatus according to claim 1, wherein:
$P_3=P_4$.
9. The apparatus according to claim 1, wherein:
said reservoir vent does not include DOT-rated explosives.
10. The apparatus according to claim 1, wherein:
said apparatus does not include DOT-rated explosives.
11. A method for dispensing fluid, comprising:
disposing fluid in a pressure vessel at a first pressure $P_1$;
disposing a reservoir at a second pressure $P_2$, and disposing said reservoir in communication with said pressure vessel via a first aperture and with an environment at a third pressure $P_3$ via a second aperture;
movably disposing a piston with said reservoir;
disposing a first burst seal in said first aperture so as to seal said pressure vessel from said reservoir, said first burst seal being engaged with said piston so as to be moveable therewith;
disposing a second burst seal in said second aperture so as to seal said reservoir from said environment;
venting said reservoir to a fourth pressure $P_4$;
wherein
$P_1>P_3$, and $P_1>P_4$;
$P_2>P_3$, and $P_2>P_4$;
said second burst seal has a rupture strength $S_2$, such that $S_2 \geqq |P_2-P_3|$;
when said reservoir vents to said fourth pressure $P_4$, said first burst seal and said piston move toward said second aperture under a pressure difference $|P_1-P_4|$ such that said piston ruptures said second burst seal; and
said first burst seal has a rupture strength $S_1$, such that $S_1>|P_1-P_2|$ and $S_1 \leqq |P_1-P_3|$, whereby when said piston stop stops said piston, said pressure difference $|P_1-P_3|$ ruptures said first burst seal, such that fluid passes through said piston apertures.
12. The method according to claim 11, further comprising:
disposing a punch on said piston such that said punch ruptures said second burst seal.
13. The method according to claim 11, further comprising:
prior to venting said reservoir, maintaining $P_1=P_2$.
14. The method according to claim 13, further comprising:
defining a pressure equalization port in communication with said pressure vessel and said reservoir, so as to maintain $P_1=P_2$ prior to venting said reservoir.
15. The method according to claim 11, wherein:
$P_1>P_2$ prior to venting said reservoir.
16. The method according to claim 11, wherein:
$P_2>P_1$ prior to venting said reservoir.
17. The method according to claim 11, wherein:
disposing an incompressible fluid within at least one of said pressure vessel and said reservoir.
18. The method according to claim 11, wherein:
$P_3=P_4$.
19. The method according to claim 11, wherein:
said reservoir vent does not include DOT-rated explosives.
20. The method according to claim 11, wherein:
said apparatus does not include DOT-rated explosives.

* * * * *